US005974617A

United States Patent [19]

Chang

[11] Patent Number: 5,974,617

[45] Date of Patent: Nov. 2, 1999

[54] WRINGER FOR A SPONGE MOP

[76] Inventor: Simon Chang, 8-5 Fl., No. 191, Fu Hsing N. Rd., Taipei, Taiwan

[21] Appl. No.: 09/093,133

[22] Filed: Jun. 8, 1998

[51] Int. Cl.[6] ..... A47L 13/12; A47L 13/144

[52] U.S. Cl. ..... 15/119.2

[58] Field of Search ..... 15/116.1, 116.2, 15/119.1, 119.2

[56] References Cited

U.S. PATENT DOCUMENTS 588,534 8/1897 Schroeder ..... 15/119.1

1,543,258 6/1925 Harrison ..... 15/119.1

2,852,794 9/1958 Blum ..... 15/119.2

*Primary Examiner*—Gary K. Graham

*Attorney, Agent, or Firm*—William E. Pelton, Esq.

[57] ABSTRACT

A wringer for a sponge mop has two side plates each respectively mounted on a respective end of a U-shaped body. Two wringing rollers are mounted on the side plates for wringing. Each side plate has a reinforced piece provided therein to increase its rigidity and strength so that the wringer will not be deformed when wringing water out of the wet sponge.

3 Claims, 5 Drawing Sheets

WRINGER FOR A SPONGE MOP

BACKGROUND OF THE INVENTION

1. Field of the Invention

The present invention relates to a wringer for a sponge mop which has reinforced pieces disposed in side plates thereof to prevent the wringer from deforming.

2. Description of Related Art

Referring to FIG. 5, a conventional sponge mop has a handle 80 securely mounted on a U-shaped wringer 81. The wringer 81 has two openings defined on the top face thereof. Two wringing rollers 82 are mounted one on each of two distal ends of the wringer 81. There are two linkages 84 passed through the openings. The lower end of the linkage 41 fastens a sponge 83. A width of the sponge 83 is large than a direction between the wringing rollers 82. The upper end of the linkage 41 are pivotally mounted on a lever 85. The lever 85 is pivotally mounted on the handle 80 at one end.

When removing water out from the wet sponge, the lever 85 is pivoted to drive upwards the linkages 84 and the sponge 83. The sponge 83, of which width is large than the gap of the side walls, will be pressed by the wringing roller 82, whereby water of the sponge is wrung out.

However, when wringing the wet sponge 83, a wringer 81 made of a plastic material will be expanded and deformed due to its low rigidity and strength, accordingly, water in the wet sponge 83 can not be wrung out fully. A wringer 81 made of steel has sufficient rigidity and strength to wring out water fully, but its cost of production is high due to a complex process.

Thus, a wringer for a sponge mop having reinforce pieces each located on each side plate of the winger tends to mitigate and/or obviate the aforementioned problem.

SUMMARY OF THE INVENTION

The main object of the present invention is to provide a wringer for a sponge mop which has reinforced pieces on the side plates of the wringer to increase rigidity and strength thereof to prevent deformation during the process of wringing out a wet sponge.

Other objects, advantages and novel features of the invention will become more apparent from the following detailed description when taken in conjunction with the accompanying drawings.

DETAILED DESCRIPTION OF THE PREFERRED EMBODIMENT

Figure 1:
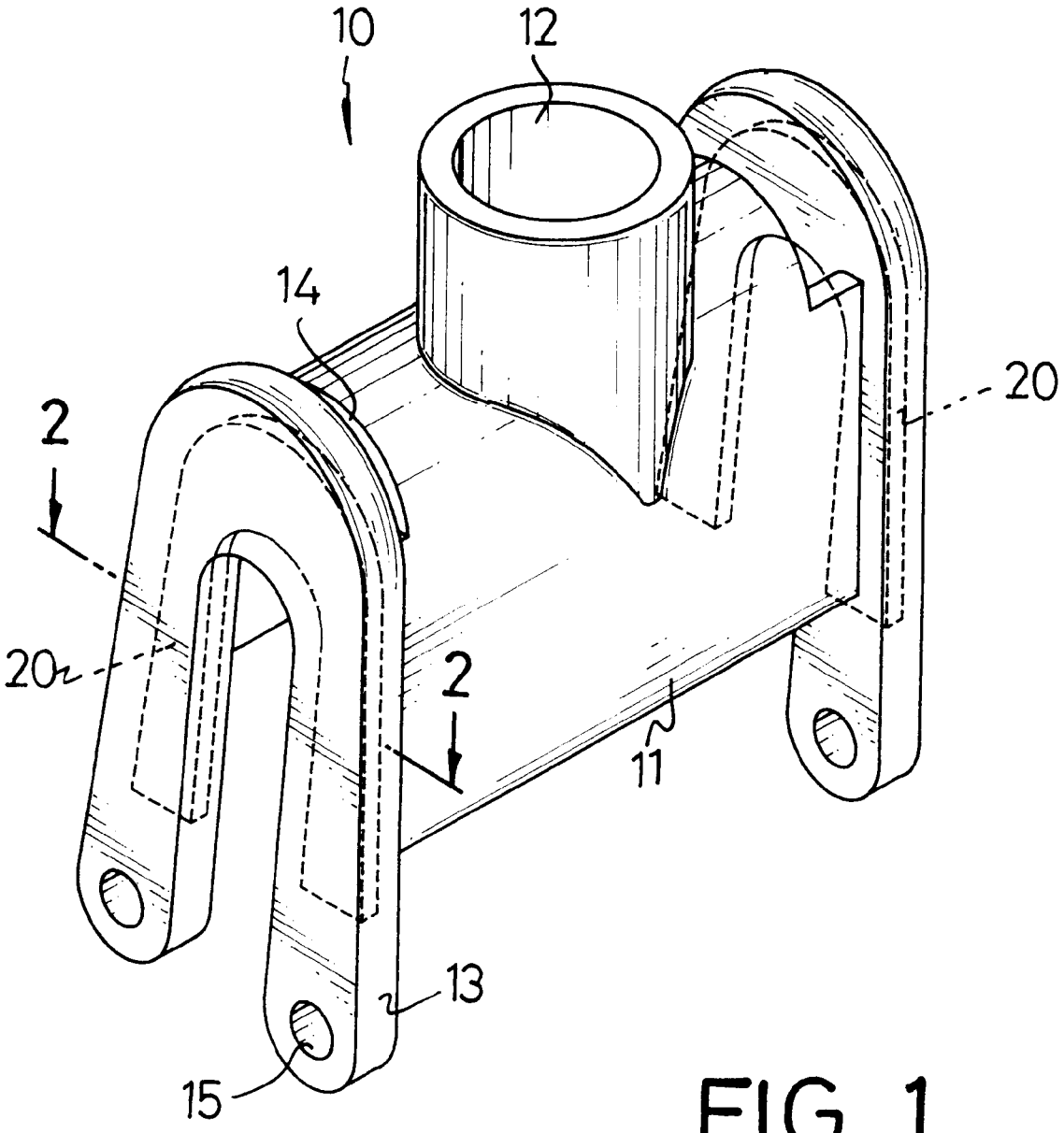
FIG. 1 is a perspective view of a wringer for a sponge mop in accordance with the present invention.
Figure 2:
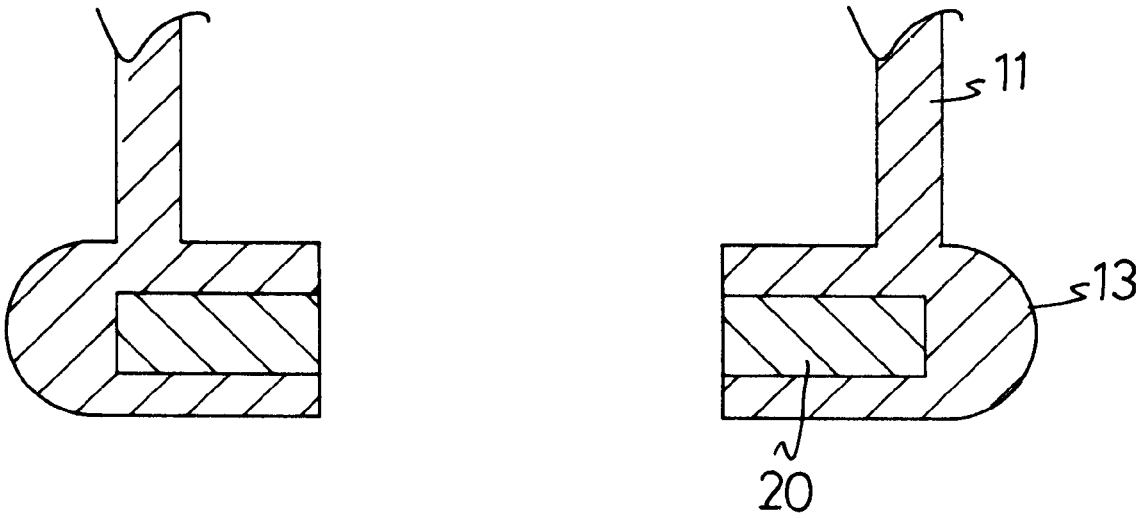
FIG. 2 is a partial sectional view of the wringer for a sponge mop in accordance with the present invention.

Referring to FIG. 1, a sponge mop wringer 10 constructed in accordance with the present invention is shown. The wringer 10 has a U-shaped body 11 with two openings 14 in the top face. A tube 12 is formed on the central portion of the top face of the body 11. Two opposed side plates 13, also U-shaped, are mounted or formed on the end face of the body 11. Each of the side plates 13 has a reinforced piece 20 located therein. The reinforced piece 20 made of steel, also U-shaped, which is added into there during a process of molding the side plate 13, is covered by the side plate 13, as shown in FIG. 2. The side plate 13 has two holes 15 at the end of each of the side plates 13 for the purpose of mounting the wringing rollers 16 (not shown).

Figure 3:
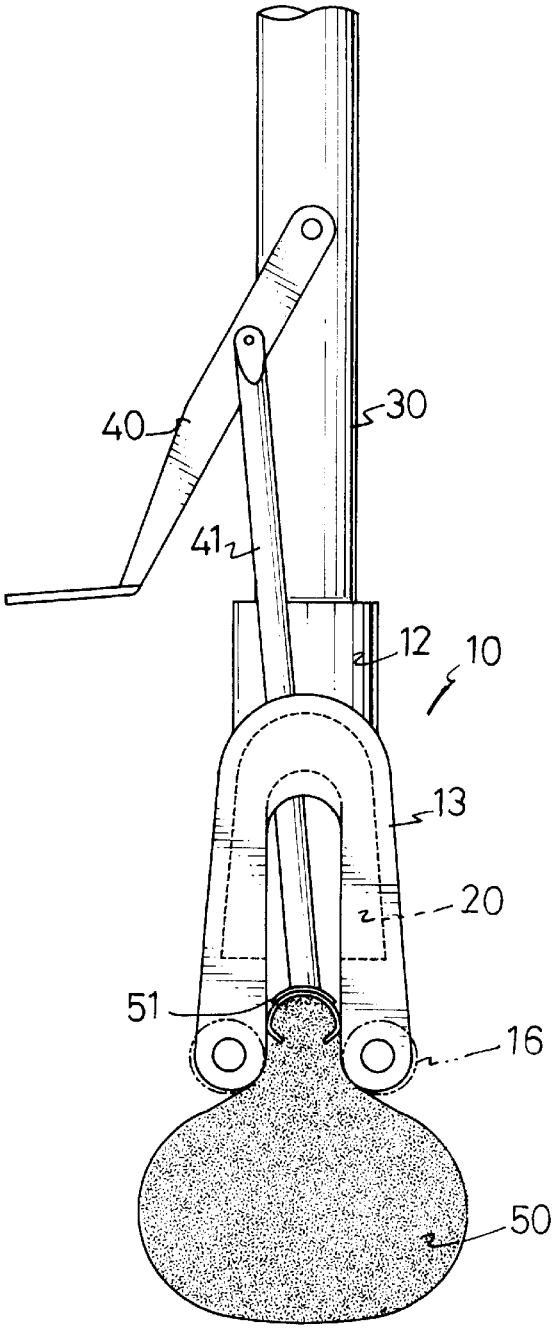
FIG. 3 is a plan view of a sponge mop constructed with the wringer in accordance with the present invention.

Referring to FIG. 3, a handle 30 is securely mounted within the tube 12. Two linkages 41 are passed through the openings 14. The lower end of the linkage 41 is securely connected to a fastener 51 which fastens a sponge 50 to the linkage 41 and the upper end of the linkage 41 is pivotally connected with a lever 40 pivotally connected to the handle 30. Two wringing roller 16 are mounted on the wringer 10 by inserting each into the opposed holes 15 of different side plates 13.

It is noted that each arm of the reinforced pieces 20 are respectively extended in a respective distal end of the side plates 13 as shown in FIG. 1, therefore the rigidity and strength of the side plates 13 are increased.

Figure 4:
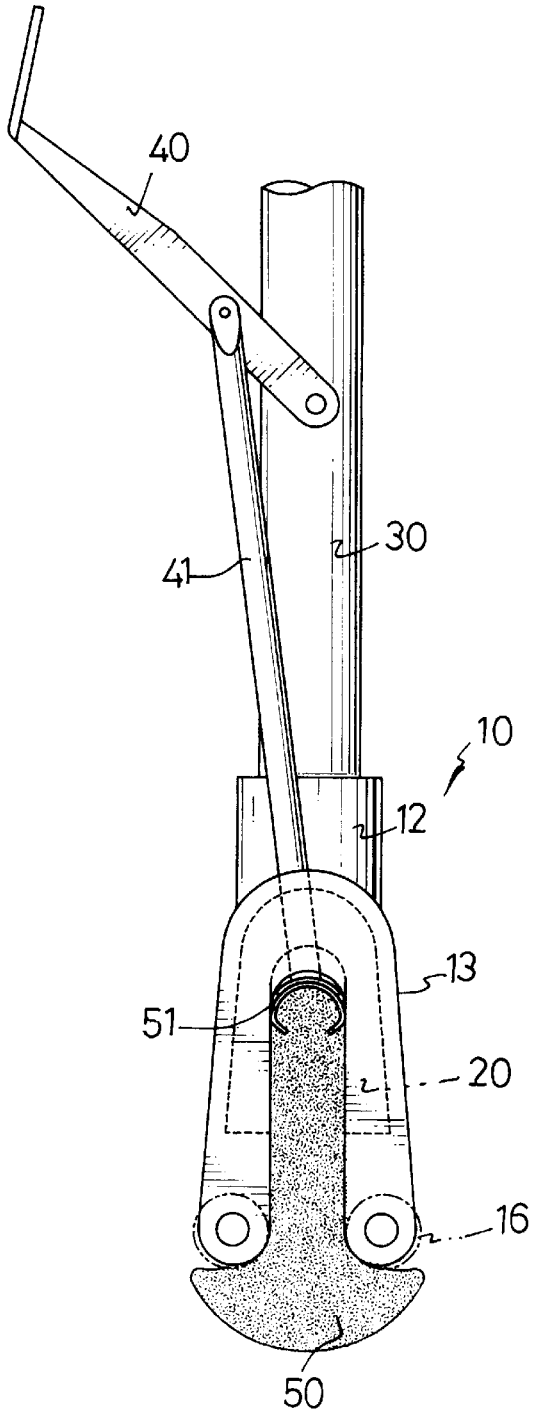
FIG. 4 is a schematic view showing the sponge being pulled upwards and wrung by the wringer of the present invention.
Figure 5:
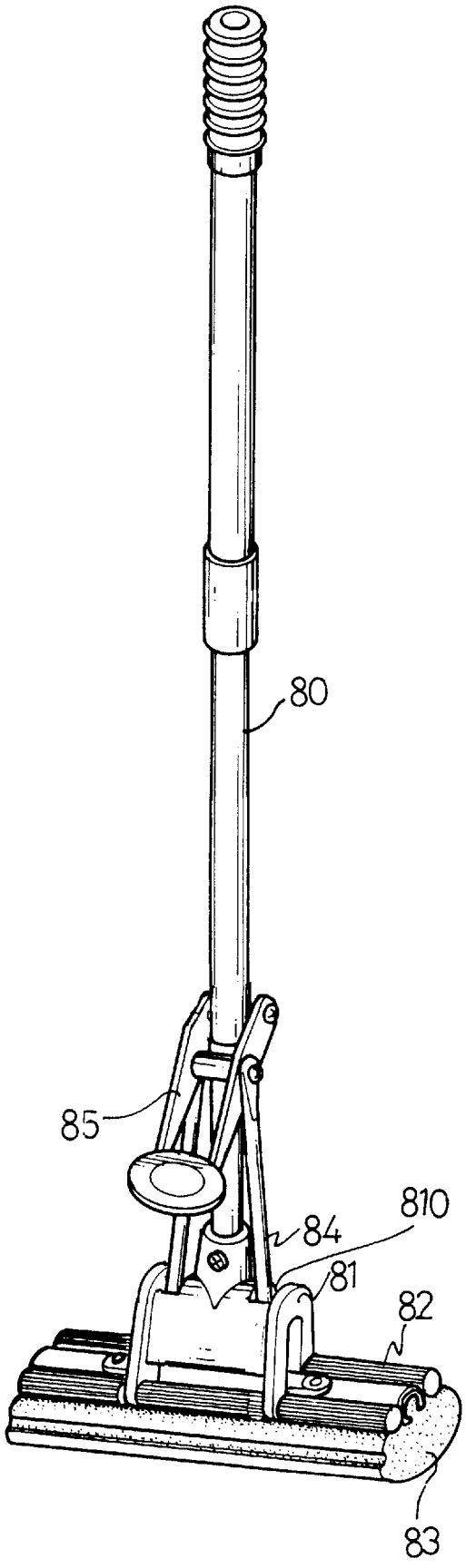
FIG. 5 PRIOR ART
FIG. 5 is a perspective view of a conventional sponge mop.
Figure 6:
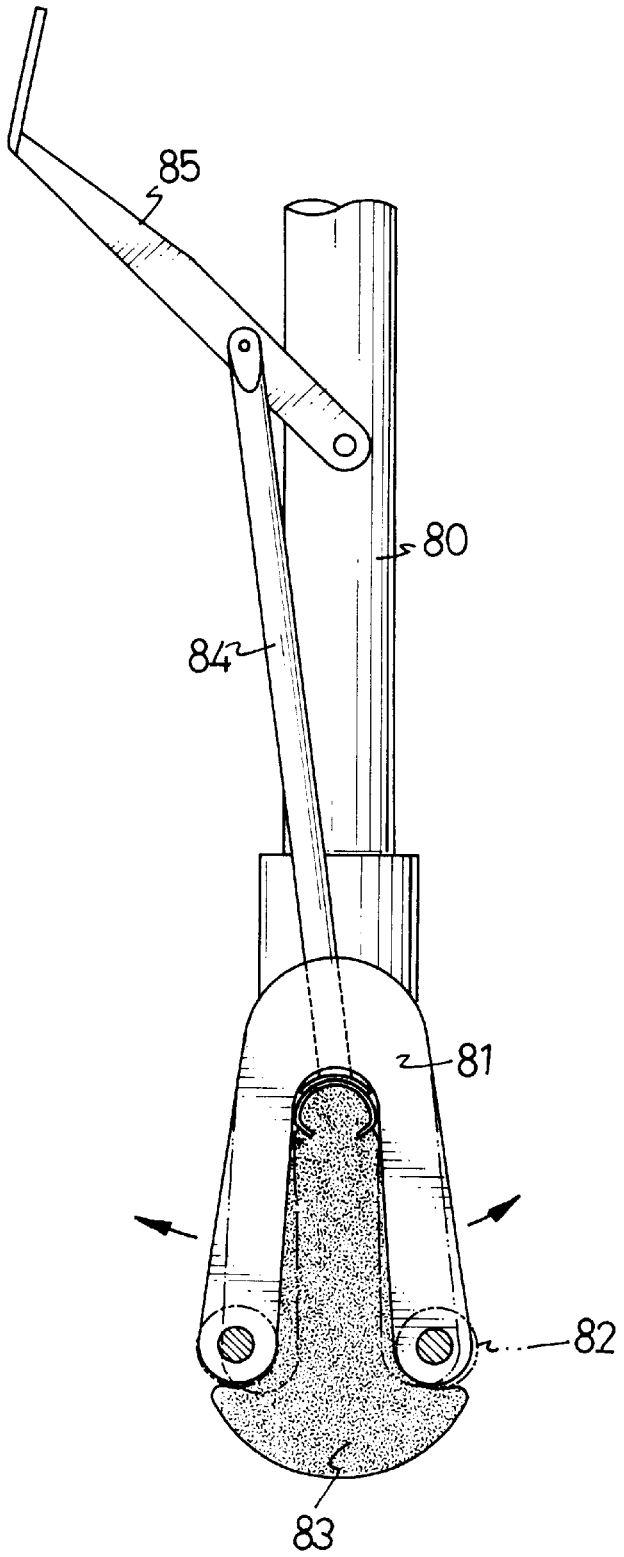
FIG. 6 PRIOR ART
FIG. 6 is a schematic view of the mop shown in FIG. 5 showing the potential deformation of the conventional sponge.

Referring to FIG. 4, for wringing the wet sponge 50, by pivoting upward the lever 40, the linkage 41 will drive the sponge 50 up between the two wringing roller 16 and the sponge 50 is compressed.

The improvements of the present invention are:

1. The rigidity and strength of the side plates are increased so that water of the sponge can be wrung out fully.

2. The cost of fabricating the wringer is low as providing only reinforce pieces thereto and not changing other structures thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wringer for a sponge mop comprising:

A body with two openings each respectively defined in a top face thereof;

a tube formed on the top face of said body;

two side plates each respectively formed on a respective end face of said body, each of said side plates having two holes defined in a respective one of distal ends thereof; and two reinforced pieces each respectively integrated into each of said side plates to prevent deformation of said wringer.

2. A wringer for a sponge mop as claimed in claim 1, wherein the reinforce pieces are made of steel.

3. A wringer for a sponge mop as claimed in claim 1, wherein each reinforce piece is U-shaped.

* * * * *